United States Patent [19]

Röck et al.

[11] 3,952,366

[45] Apr. 27, 1976

[54] HINGE DEVICE

[75] Inventors: Erich Röck, Hochst; Bernhard Mages, Dornbirn, both of Austria

[73] Assignee: Blum Gesellschaft m.b.H., Hochst, Austria

[22] Filed: Feb. 24, 1975

[21] Appl. No.: 552,149

[30] Foreign Application Priority Data

Feb. 26, 1974 Austria ..... 1567/74
Apr. 2, 1974 Austria ..... 2745/74

[52] U.S. Cl. ..... 16/129
[51] Int. Cl.[2] ..... E05D 7/04
[58] Field of Search ..... 16/129–134

[56] References Cited

UNITED STATES PATENTS

| | | | |
|---|---|---|---|
| 3,148,407 | 9/1964 | Glasbrenner | 16/129 |
| 3,748,689 | 7/1973 | Granert | 16/129 |
| 3,772,735 | 11/1973 | Lautenschlaegen | 16/129 |
| 3,863,292 | 2/1975 | Grunert | 16/130 X |

*Primary Examiner*—G. V. Larkin
*Attorney, Agent, or Firm*—Wenderoth, Lind & Ponack

[57] ABSTRACT

A hinge device especially for furniture doors with at least one mounting plate fixed to one part of the furniture, and a hinge arm bearing swivel arms and anchored to the mounting plate wherein the mounting plate is provided with at least one centering part for centering the hinge arm or a portion of the hinge arm. The hinge arm may also be provided with a centering part that can be snapped into the mounting plate. Also, the hinge arm can be inserted into guides of the mounting plate.

8 Claims, 8 Drawing Figures

HINGE DEVICE

BACKGROUND OF THE INVENTION

The invention relates to a hinge device especially for furniture doors including at least one mounting plate that can be fixed onto one part of the furniture and a hinge arm which can be anchored directly or indirectly to the mounting plate and which bears swivel arms or similiar hinge elements.

Conventional hinge devices of that kind offer the advantage that the respective mounting plate can be fixed to the corresponding part of the furniture, e.g. the side wall, before the assemblage of the piece of furniture, and that on assemblage the hinge arm itself, which is linked to a hinge boss in the furniture door by swivel arms, need only be inserted onto the mounting plate. That is, at the time at which the whole weight of the door must be carried by the hinge, no installation work demanding more time or more precision is necessary.

In the conventional hinge devices a hinge arm or an intermediate part belonging to the hinge arm is inserted into guides of the mounting plate and afterwards fixed by means of a setscrew that abuts against the mounting plate.

SUMMARY OF THE INVENTION

The object of the present invention is to provide a hinge device of the above type, but which is simpler than prior art hinge devices with regard to its functioning and cheaper with regard to production costs.

According to the present invention this is achieved by the fact that the mounting plate is provided with at least one centering part for the hinge arm or for a mounting part, e.g. an intermediate part, of the hinge arm, and/or by providing that the hinge arm or the intermediate part is provided with a centering part that snaps into the mounting plate, the hinge arm or the intermediate part being insertable into guides of the mounting plate.

Preferably the mounting plate has two centering parts for the hinge arm or for a mounting part, e.g. an intermediate part, of the hinge arm, which centering parts are situated opposite each other and form an insertion slot between them into which slot a centering part belonging to the hinge arm or an intermediate part can be snapped.

Furthermore it is provided that the centering parts of the mounting plate are represented by yielding projections or flaps.

A preferred embodiment provides that the mounting plate and the centering parts are formed as one plastic member.

Preferably the centering part of the hinge arm or the intermediate part is in the form of a projection or a bar.

In such case the invention provides the bar to be as a rim punched out from the hinge arm or the intermediate part.

BRIEF DESCRIPTION OF THE DRAWINGS

The invention is described hereinafter in detail with reference to specific embodiments thereof and with regard to the attached drawings, wherein.

DETAILED DESCRIPTION OF THE INVENTION

Figure 8:
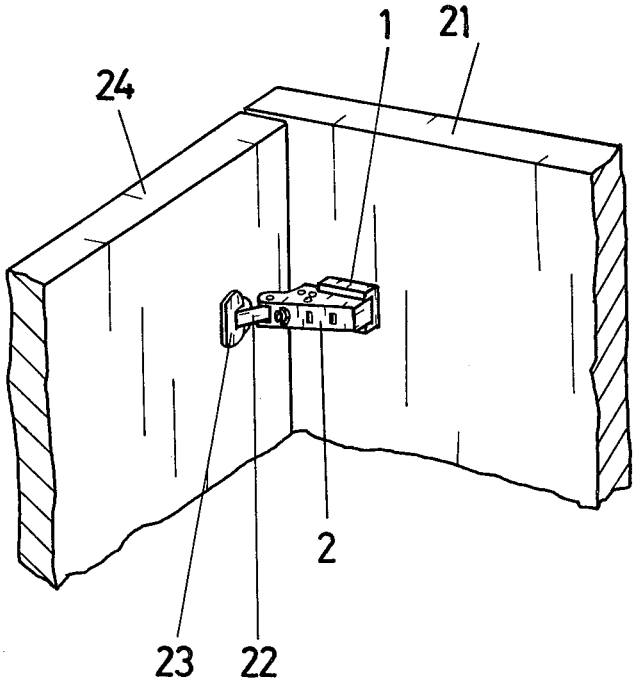
FIG. 8 is a perspective illustration of the connection of a side wall and a door by means of a hinge according to the invention.

The hinge device according to the invention has a mounting plate 1 which can be fixed by screws, dowels or the like to a part of the furniture, e.g. the side wall 21 (see FIG. 8). The hinge arm 2 which is fixed onto the mounting plate 1 is connected by swivel arms 22 with a dowel pot 23 situated in a borehole of the door 24.

The mounting plate 1 is provided with longitudinally extending recesses or guides 4 in the lateral sides of plate 1, at the front and rear ends thereof, into which guides the anchorings or projections 3 of the hinge arm 2 are insertable.

In the embodiments illustrated the anchorings 3 are represented by bent flaps of the lateral walls of the hinge arm 2.

The flaps or anchorings 3 are also arranged in the front and the rear areas of the hinge arm 2 at a distance from each other, thus forming an interspace 15 between the flaps on each lateral side of hinge arm 2, which interspace 15 corresponds to interspaces 16 between the guides 4 on each side of the mounting plate 1.

This embodiment allows the hinge arm 2 to be centrally mounted onto the mounting plate 1 by inserting projections 3 at one end of hinge arm 2 into interspace 16, and then sliding projections 3 longitudinally into recesses 4. Accordingly, hinge arm 2 need not be displaced along its whole length to be mounted on mounting plate 1, thus providing an insertion path which is considerably shorter.

Figure 1:
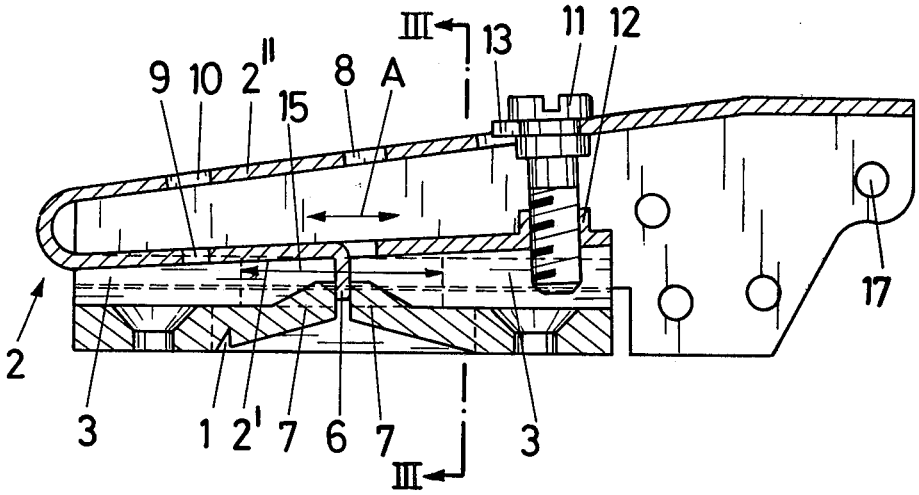
FIG. 1 is a longitudinal section of a hinge device according to the invention, taken along line I—I of FIG. 2.
Figure 2:
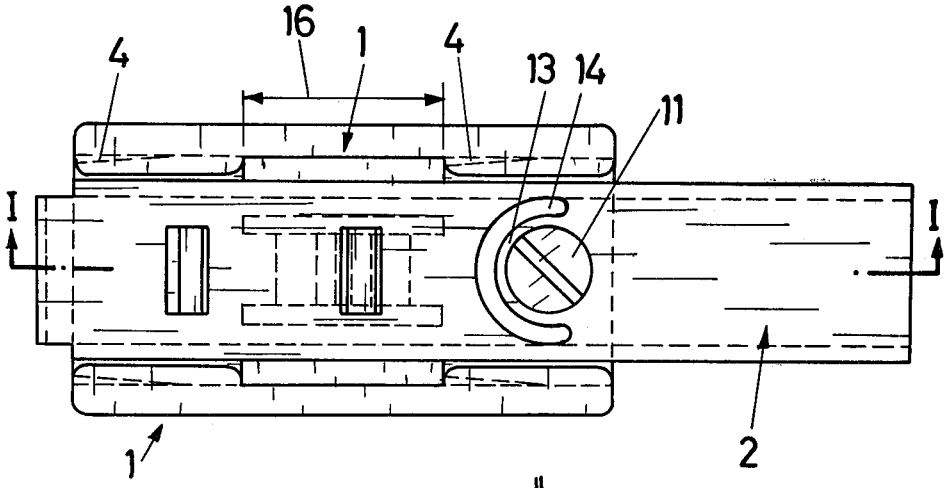
FIG. 2 is a top elevational view of a hinge device according to the invention.
Figure 3:
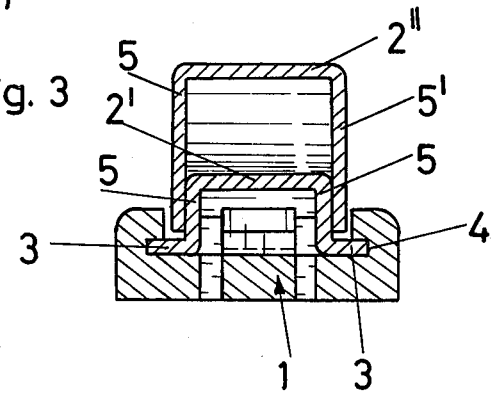
FIG. 3 is a section taken along the line III—III of FIG. 1.

In the embodiment according to FIGS. 1 to 3 the hinge arm 2 is provided with a centering part 6 represented by a projection, which, in mounting position, snaps into an insertion slot between the two flaps or lips 7 of the mounting plate 1. The flaps 7 are represented by elastic centering parts of the mounting plate 1.

The projection 6 and the flaps 7 eliminate the need for a particular fixing screw for tightening hinge arm 2 in place on plate 1. Furthermore the symmetric shape of the mounting plate prevents the latter from being mounted in the wrong direction when it is attached to the furniture side wall 21.

As can be seen from FIG. 1 the hinge arm 2 has a longitudinal sectional configuration which resembles a U, thus having a lower holding portion 2' which can be anchored in the mounting plate 1 and an upper load bearing portion 2'' which is provided with the bearings 17 for the swivel arms. Holding portion 2' and load bearing portion 2'' are bent and joined to each other at the end of hinge arm 2 opposite the swivel arm bearings 17.

As can be seen also from FIG. 1 the hinge arm 2 is provided with perforations 9 and 10 arranged respectively in the lower portion 2' and in the upper portion

2''.

The perforations 9 and 10 permit the portions 2' and 2'' to be moved in the direction of the arrow A by means of a tool, e.g. a screw driver, inserted into the perforations. Thus an adjustment possibility in direction of the depth of the furniture is provided.

Furthermore the portions 2' and 2'' of the hinge arm 2 are interconnected at their front end by an adjustment screw 11. This adjustment screw 11 screws into a thread 12 of the lower portion 2' and is fastened, e.g. by riveting, into a flap 13 of the upper portion 2''. Flap 13 is formed by a slot 14 which is in the shape of a semi-circle.

By turning the adjustment screw 11 the portion 2'' of the hinge arm 2 can be lifted from or pressed towards the portion 2', i.e. the furniture side wall 21, thus permitting adjustment of the gap between the edge of the door 24 and the furniture side wall 21.

Accordingly, the flap 13 prevents the adjustment screw 11 from inhibiting the displacement of the hinge arm in the direction of the depth of the furniture.

For this purpose the thread 12 cannot be an exactly round one, but rather slot-shaped in order to permit the slight participation of screw 11 in the depth adjustment.

Figure 4:
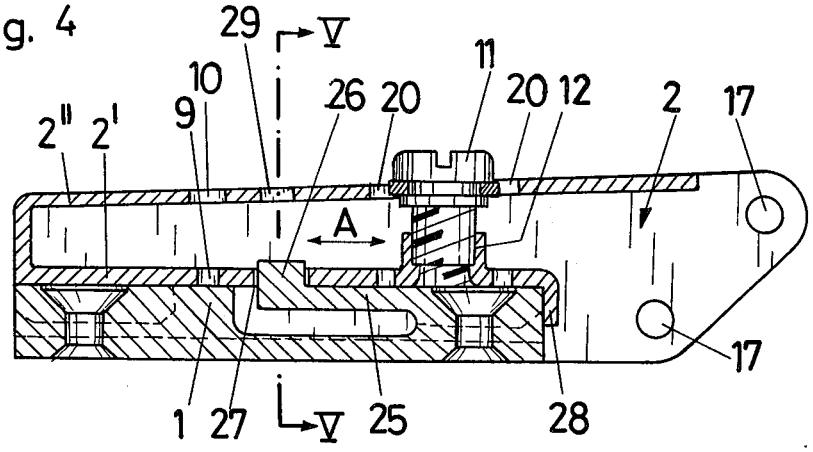
FIG. 4 is a longitudinal section of a further embodiment of a hinge device according to the invention.
Figure 5:
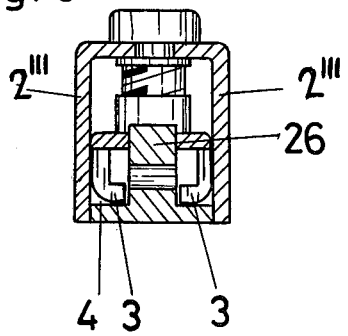
FIG. 5 is a section taken along the line V—V of FIG. 4.
Figure 6:
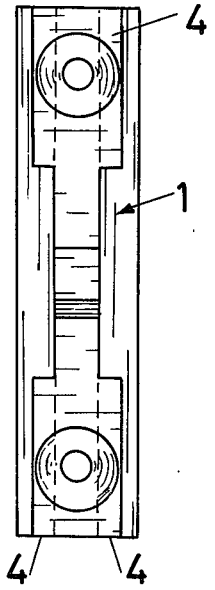
FIG. 6 is a top elevational view of a mounting plate according to FIG. 4.

In the embodiment according to FIG. 4 the mounting plate 1 is provided with an elastic arm 25 directed towards the inside of the furniture and provided with a pin 26 on its outer end.

In mounting position the pin 26 fits into a corresponding clearance or opening 27 in the lower portion of the hinge arm 2.

In this case the lower portion 2' of the hinge arm 2 is furthermore provided with a stop 28 at its front end, which stop insures rapid location of pin 26 when the hinge arm 2 is inserted and mounted onto plate 1.

In this case the hinge arm 2 is again held by anchorings 3 which fit into corresponding lateral guides 4 of the mounting plate 1.

In order to effect an adjustment of the bearings 17 with respect to the mounting plate 1 the hinge arm 2 can be deformed or bent similar to the embodiment shown in FIG. 1.

By means of the adjustment screw 11 the upper portion 2'' can be lifted from or pressed towards the lower portion 2'. Therefore the adjustment screw 11 is riveted into the upper portion 2'' and screws into threads 12 of the lower portion 2'.

Adjustment in the direction of the depth of the furniture is achieved by means of the two perforations 9 and 10 which are provided for the insertion of a screw driver or another appropriate tool.

Furthermore the upper portion 2'' is provided with a perforation 29 which again permits insertion of a tool for pressing down the pin 26, to thereby loosen the hinge arm 2 from its anchoring in the mounting plate 1.

The portion 2'' is provided with flanks or sides 2''' which embrace the portion 2' and thus contribute considerably towards the stability of the hinge device.

Figure 7:
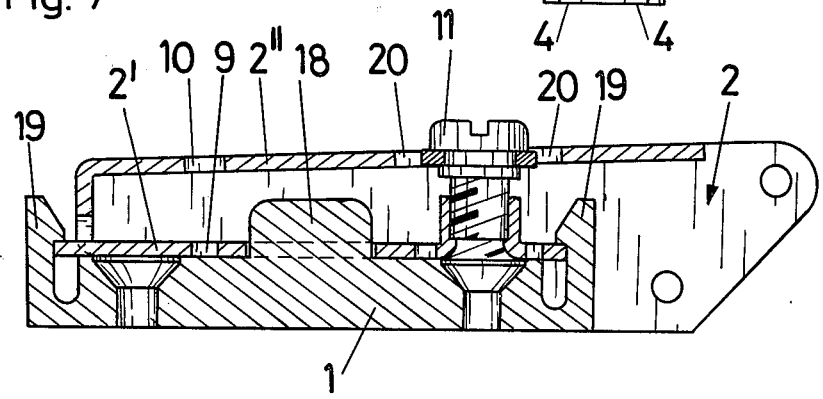
FIG. 7 is a longitudinal section of a further embodiment according to the invention.

In the embodiment according to FIG. 7 the mounting plate 1 has a fixed centering part 18 as well as further centering parts which are represented by hooks 19 at the front and rear surfaces. In this case the hooks 19 are elastic parts of the mounting plate 1.

In this case the hinge arm 2 itself can be inserted and snapped into the mounting plate 1 directly from above.

The hinge arm 2 is also provided with a load bearing portion 2'' and a holding portion 2', and again the adjustment thereof is accomplished similar to the embodiment shown in FIG. 1, i.e. by means of the adjustment screw 11 and the perforations 9 and 10.

In the embodiments according to FIGS. 4 and 7 slots 20 are provided in front of and behind the adjustment screw 11 in order to give the adjustment screw a certain flexibility in the portion 2'', thus preventing it from inhibiting adjustment in the depth direction.

What we claim is:

1. In a hinge device, especially for furniture doors, of the type including at least one mounting plate that can be fixed to one part of a piece of furniture, and a hinge arm which can be anchored directly or indirectly to said mounting plate and which bears swivel arms for connection to another part of a piece of furniture, the improvement wherein:

said mounting plate is provided with at least one centering part means for centering said hinge arm;

said hinge arm is provided with a centering part means for snap fitting engagement into the mounting plate.

2. The improvement claimed in claim 1, wherein said mounting plate is provided with two centering part means spaced from each other, thereby forming between each other an insertion slot means for receiving said centering part means of said hinge arm.

3. The improvement claimed in claim 1, wherein said centering part means comprise elastic projections or flaps.

4. The improvement claimed in claim 1 wherein said centering part means of said hinge arm comprises a projection or bar.

5. The improvement claimed in claim 4, wherein said bar comprises a flap formed in said hinge arm.

6. The improvement claimed in claim 1, wherein said hinge arm is further provided with a stop.

7. The improvement claimed in claim 1, wherein said mounting plate centering part means comprise elastic hooks on opposite ends of said mounting plate.

8. The improvement claimed in claim 1, wherein said mounting plate and said centering part means thereof comprise a single plastic part.

* * * * *